United States Patent [19]

Beech

[11] Patent Number: 4,597,126

[45] Date of Patent: Jul. 1, 1986

[54] MACHINE FOR CLEANING A PLURALITY OF FLOOR MAINTENANCE PADS

[76] Inventor: Robert A. Beech, 310 Thompson Run Rd., Pittsburgh, Pa. 15237

[21] Appl. No.: 732,925

[22] Filed: May 13, 1985

[51] Int. Cl.[4] ..... A47L 25/00

[52] U.S. Cl. ..... 15/3; 15/21 B; 15/89; 15/93 R; 134/149; 134/159; 134/155

[58] Field of Search ..... 15/3, 21 B, 38, 89, 15/97 R, 93 R, 94, 142; 134/149, 159, 104, 155, 6

[56] References Cited

U.S. PATENT DOCUMENTS

| | | | |
|---|---|---|---|
| 1,061,157 | 5/1913 | Bemis | 15/21 B |
| 1,688,244 | 10/1928 | Molstad . | |
| 1,839,762 | 1/1932 | Johnston . | |
| 2,225,501 | 12/1940 | Lapham et al. | 141/1 |
| 2,503,687 | 4/1950 | Richard | 134/149 |
| 2,519,259 | 8/1950 | Liebman | 15/89 |
| 2,576,185 | 11/1951 | MacKenzie | 15/3 |
| 3,077,622 | 2/1963 | Murphy | 15/4 |
| 4,056,114 | 11/1977 | Boutillette | 134/104 |

*Primary Examiner*—Edward L. Roberts

*Attorney, Agent, or Firm*—Webb, Burden, Robinson & Webb

[57] ABSTRACT

A machine for cleaning a plurality of floor maintenance pads by rotation and agitation in a tank of cleaning solvent. The pads are loaded onto a drive axle with gripper rings placed therebetween. After rotation in a solvent, the pads rotate against an agitator bar frame which contacts with both sides of the pads simultaneously. Preferably, the solvent drained from the tank can be returned to a container for reuse or discharged depending upon its level of contamination. Most preferably, the cleaning machine and the container of cleaning solvent are positioned together on a movable support stand.

10 Claims, 9 Drawing Figures

MACHINE FOR CLEANING A PLURALITY OF FLOOR MAINTENANCE PADS

BACKGROUND OF THE INVENTION

1. Field of the Invention

My invention relates to a machine for cleaning a plurality of disc-shaped items of various sizes. More particularly, my invention relates to a machine for cleaning a plurality of floor maintenance pads. The pads are cleaned by rotation and agitation in a cleaning solvent.

2. Description of the Prior Art

Most walking surfaces in public areas require some sort of daily preservation. The floor areas of most buildings are maintained either by in-house personnel or by professional cleaning companies. Typically, these parties employ some sort of commercially manufactured floor scrubber, cleaner or polisher. These machines operate by rotating a pad or set of pads across the area of the floor to be stripped, cleaned, waxed and/or buffed. Generally, these machines operate in conjunction with a variety of stripping, cleaning and waxing solvents. The physical construction of these pads differ somewhat depending upon their intended use. The maintenance pads used for floor stripping and cleaning, for example, function by collecting soil within the mesh network of the pads as they are moved across the floor.

The pads used with most commercial floor scrubbers, cleaners and polishers are disc-shaped. They are generally on the order of $\frac{5}{8}$ inch to $\frac{7}{8}$ inch thick and have a circular core through which they are mounted for use. The pad material, comprised of a mesh network, is prepared in sheet form, with individual floor pads stamped out therefrom. Because of this uniformity stamping, most pads have a circular core with about a 3-$\frac{1}{2}$ inch diameter through the center. The outer diameters of these pads vary in size depending upon their intended use and the brand of commercial machine involved.

Once a floor pad becomes sufficiently saturated with soil, it is removed and typically discarded with a new pad inserted in its place. Though these pads are readily available and sold in bulk quantities, the increasing costs of said pads necessitate more than one use per pad. Because of its mesh network construction, a floor pad can be reused if it is sufficiently cleaned. A majority of the soil contained within the mesh network can be dislodged by pressurized hosing of the pad with water. However, this particular pad cleaning operation is only conducted on one pad at a time in a slop sink area. No other means of cleaning floor maintenance pads for reuse are presently known.

It is known that a plurality of disc-shaped items can be cleaned by rotation in a suitable cleaning fluid. In U.S. Pat. No. 1,688,244, a plurality of cream separator skimmer discs were placed upon a rotatable, vertical rod. A cleaning arm was positioned between each disc and attached to a side frame for engaging both the upper and lower sides of adjacent discs. Additionally, it is known that these same skimmer discs can be washed in a pressurized water bath while spun on motorized axles. U.S. Pat. No. 2,225,501.

It is also known that a plurality of rotary brushes can be cleaned by positioning them upon a motorized, vertical axle for placement in a container of cleaning solution. The brushes are further cleaned by being rotated against a set of vertical scrapers and brush combs as in U.S. Pat. No. 2,576,185.

SUMMARY OF THE INVENTION

I have now provided a machine for cleaning a plurality of floor maintenance pads. My invention cleans pads with various outer diameters simultaneously. The pads are doubly cleaned by rotation and agitation in a tank with cleaning solvent. My invention does not require cleaning by a pressurized water bath nor does it require operation in a slop sink area.

My invention comprises a top-loading operating tank having removable drive axle rotatably and horizontally mounted therein upon which a plurality of floor pads are loaded. The pads are held in place on the axle by gripper rings placed therebetween. A rotatable shaft connects the axle to a variable speed motor located outside the tank. An electric pump for filling the tank with cleaning solvent is located adjacent to the motor. The pads are further rotated against a plurality of uniformly spaced agitator bars attached to a frame, mounted to the interior of the operating tank.

Preferably, my invention further comprises a pair of drain valves leading from the tank basin which return reusable solvent to its original container or, alternatively, discharge overly contaminated solvent. Most preferably, all of the above, including the container of cleaning solvent, are positioned on a movable support stand for greater utility of my invention.

DESCRIPTION OF THE PREFERRED EMBODIMENTS

In the practice of my invention, a plurality of floor maintenance pads are cleaned. Pads which have various outer diameters can be cleaned simultaneously with my cleaning machine. Because of the uniformity of core inner diameters in most floor pads, a drive axle with this common diameter is used. Also, due to slight deviations in common pad thicknesses, a plurality of agitator bars can be attached to an agitator bar frame and uniformly spaced apart.

The cleaning solvent employed by my invention can be any of the commercial or industrial cleaners presently used to clean and strip floors. By the rotation of the floor pads in this solvent, soil particles are sufficiently loosened for removal. Additional soil is removed by rotation against the agitator bar frame. Like the pads themselves, most solvents are worthy of at least one or two additional uses before disposal. Therefore, in a preferred embodiment of my invention, the drain from the operating tank is supplied with dual valves for returning reusable cleaning solvent to the container or, alternatively, discharging overly contaminated solvent.

Figure 1:
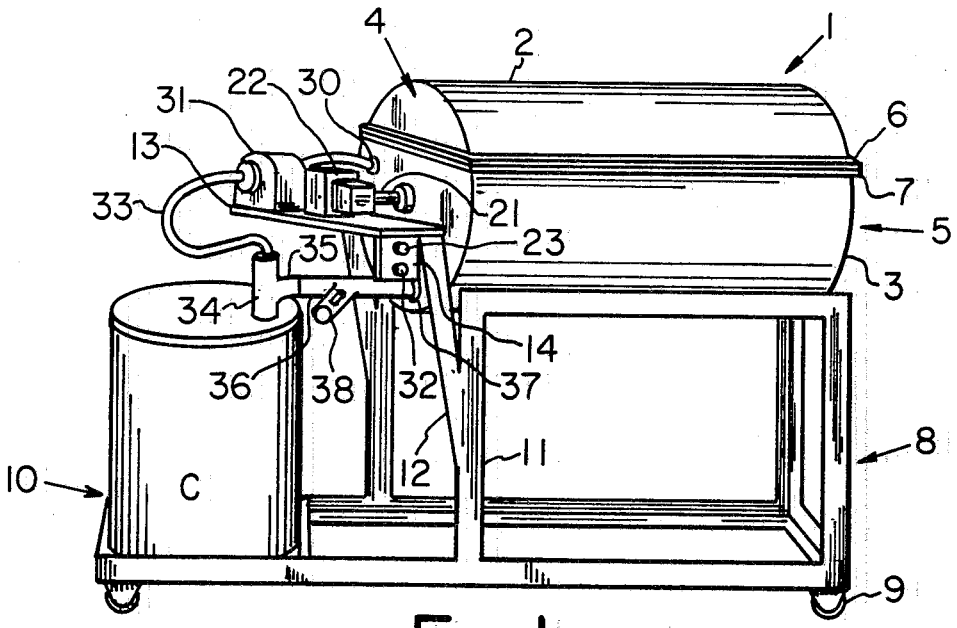
FIG. 1 is a perspective view of the cleaning machine with a container of cleaning solvent on the support stand.

As shown in FIG. 1, the operating tank 1 is cylindrically shaped and unevenly divided into a tank top 2 and tank basin 3. The tank 1 has an active end 4 and a dummy end 5, not fully shown in FIG. 1. The edges to the tank top 2 and tank basin 3 are lipped, 6 and 7 respectively, but need not create a water-tight seal since operation of my invention does not create excessive splash and solvent. Preferably, the tank sits horizontally on a support stand 8, having casters 9 on the lower end for greater mobility. The stand 8 also has an area 10 for supporting a container of cleaning solvent C adjacent to the tank 1.

A pair of angled, activities platform braces 12 are mounted to the front tank arms 11 of the tank support stand 8. These braces 12 attach to and support an activities platform 13 located between the active end 4 of the tank 1 and the container of cleaning solvent C. A switch plate 14 is mounted perpendicular to the end of the activities platform 13 closest to the front of the support stand 8.

A central shaft hole 20 is drilled through the center of the active end 4 of the tank 1. Through this hole 20, a rotatable shaft 21 is positioned for attaching to the horizontally and rotatably mounted drive axle within the tank 1. The other end of the shaft 21 connects to a variable speed motor 22, mounted onto the activities platform 13 and controlled by the motor on/off switch 23 on the switch plate 14.

The inlet 30 for entry of solvent into the tank can be anywhere on the tank. This inlet 30 is connected to an electric pump 31, located and mounted on the activities platform 13 next to the motor 22. The electric pump 31 is operationally controlled by the pump on/off switch 32, similarly located with the motor switch 23 on the switch plate 14 to the front of the support stand 8.

The pump 31 is connected by hosing 33 to a dual inlet valve 34 into the container of cleaning solvent. Specifically, the hosing 33 connects the pump 31 to the top of the valve 34 while the other inlet 35 to the valve 34 connects to the return valve 36 leading from the drain hole 37 at the tank basin 3. An alternative valve, namely the discharge valve 38, also runs from the drain hole 37.

The connection between the return valve 36 and discharge valve 38 is purposefully branched. When the solvent within the tank is determined to be reusable, i.e., relatively free of contaminating soil particles removed from the floor pads, the return valve 36 is opened and the discharge valve 38 is closed in order that the solvent can be returned to its original container. If the solvent is overly contaminated after the running of a cleaning cycle, the inverse operation of the aforementioned valves will allow for the discharge of solvent from the tank for proper disposal.

Figure 2:
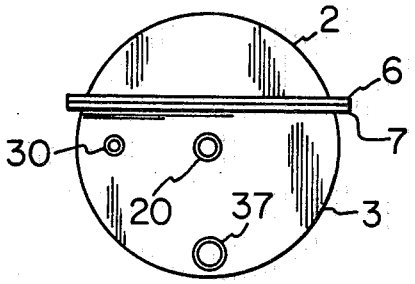
FIG. 2 is a front view of the active end of the operating tank.

As shown in FIG. 2, the active end 4 of the tank 1 comprises a tank top 2 and tank basin 3. Preferably, the shaft hole 20 runs through the direct center of the active end 4 of the tank. As the tank 1 is unevenly divided in my preferred embodiment, the shaft hole 20 enters through the upper middle portion of the tank basin 3. In my preferred embodiment, the inlet 30 is located to the left of the shaft hole 20 with the drain hole 37 from the tank located directly below the shaft hole 20. The drain hole 37 should not be at the lowermost point of the tank basin 3, but rather slightly above. This will allow a slight amount of solvent to remain in the tank after draining for retention of the sediment removed from the floor pads. This sediment will be eventually discarded with the flushing of the tank after all cleaning cycles are completed.

Figure 3:
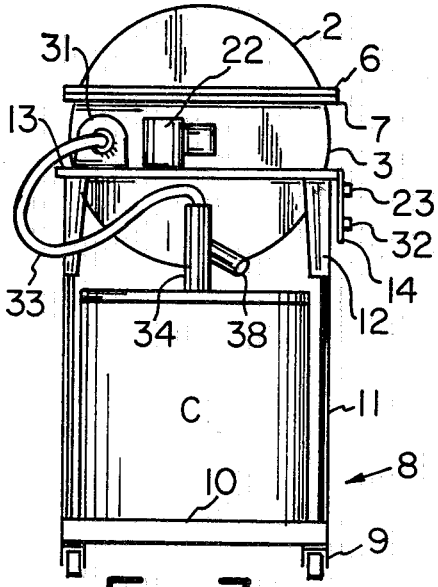
FIG. 3 is a front view of the active end of the cleaning machine with a container of cleaning solvent on the support stand.

FIG. 3 is the same view of the tank 1 as shown in FIG. 2, but with all activities in place. The tank 1, itself, is atop the support stand 8 with the container of cleaning solvent C in its corresponding stand area 10. From this view of the tank, the motor 22 and pump 31 are visible on the activities platform 13, but their corresponding holes and inlets into the tank basin 3 are hidden. Likewise, from this angle, only the discharge valve 38 and dual inlet valve 34 are visible, with the return valve and drain hole precluded from view. The switch plate 14 appears to the right of the activities platform 13 in FIG. 3 with the motor switch 23 directly above the pump switch 32.

Figure 4:
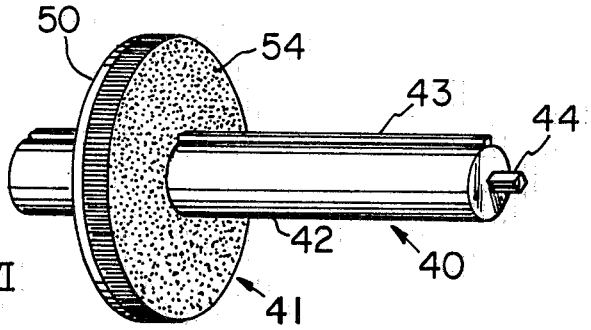
FIG. 4 is a perspective view of the drive axle with gripper key and a keyed gripper ring.

FIG. 4 shows the drive axle 40 upon which floor pads and gripper rings 41 are alternately loaded prior to its positioning within the tank basin 3. The drive axle 40 includes a cylindrical drive shaft 42 on the order of 30 to 35 inches in length and 3 to 4 inches in diameter. Most preferably, the shaft is about 31 inches long and about 3-$\frac{1}{2}$ inches in diameter. This diameter corresponds to the inner core diameter running through most floor pads. A square gripper key 43 extends the length of the shaft 42 and protrudes above the surface on the order of $\frac{1}{8}$ inch to $\frac{1}{2}$ inch. Most preferably, this key 43 protrudes $\frac{1}{4}$ inch square above the surface of the cylinder. The key 43 will be used in conjunction with keyed gripper rings for holding the pads in place on the rotatable drive axle. The shaft 42 has boxed ends 44 for insertion into a pair of drive shaft mounts in the inner walls of the tank basin 3. These mounts should contain bearing pillows for easier rotation of the loaded drive axle.

Figure 6:
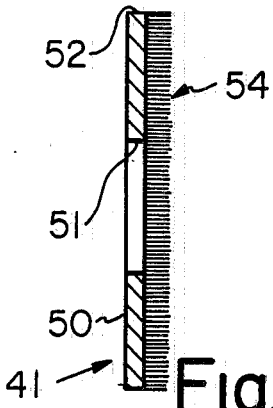
FIG. 6 is a section taken along lines VI—VI of FIG. 5.
Figure 5:
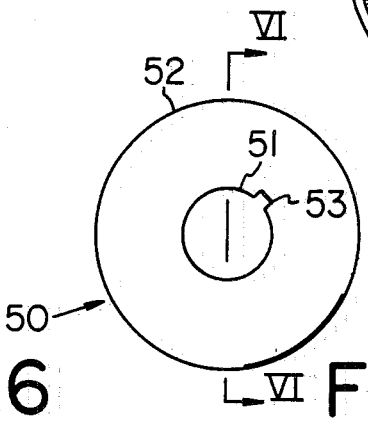
FIG. 5 is a back view of the keyed gripper ring.

The gripper ring 41 which is positioned between each floor pad on the drive axle 40 is shown in two separate views, FIG. 5 and FIG. 6. The ring 41 is comprised of a circular metal backing plate 50, FIG. 5. The backing plate 50 has an inside diameter 51 slightly larger than the diameter of the drive axle 40 and an outside diameter 52 on the order of 6 to 6-$\frac{1}{2}$ inches. Most preferably, the backing plate has an inside diameter of about 3-$\frac{5}{8}$ inches and an outside diameter of about 6-$\frac{1}{4}$ inches. The inside diameter 51 of the backing plate 50 includes at least one key 53 indented inwardly which is sized to correspond to the square gripper key 43 extending the length of the drive axle 40. This key 53 is preferably about $\frac{1}{4}$ inch square. A spiny, gripping material 54 is attached to at least one side of the backing plate 50. This material grips onto the adjacent floor pad holding it in place on the drive axle while allowing for slight movement therebetween.

Figure 7:
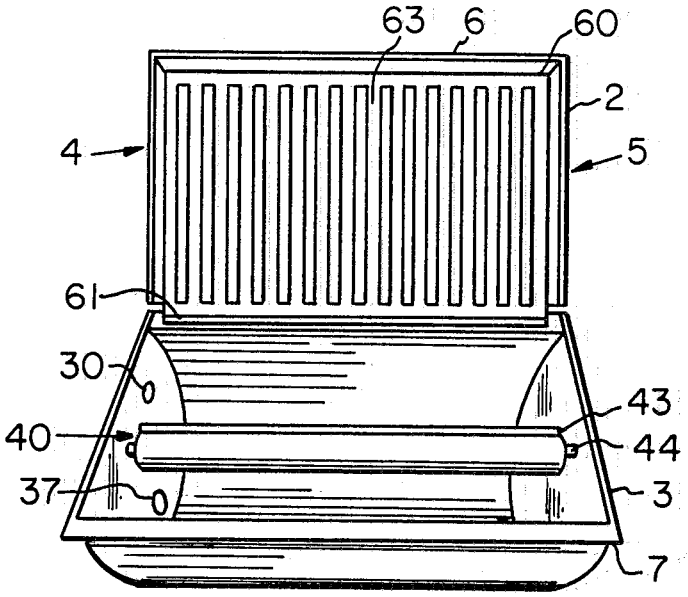
FIG. 7 is a perspective, elevational view of an open operating tank with agitator bar frame raised.
Figure 8:
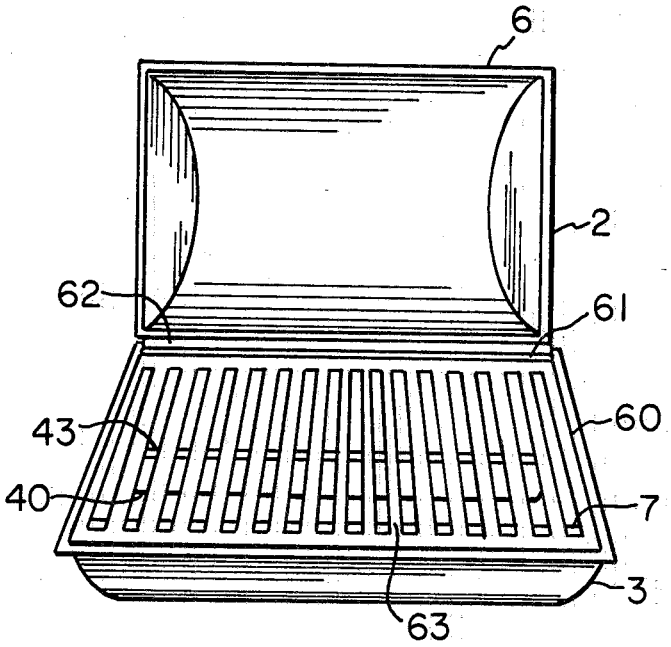
FIG. 8 is a perspective, elevational view of the tank with agitator bar frame lowered into position.

As shown in FIG. 7, the open operating tank 1 contains an agitator bar frame 60 connected to the interior of the tank basin 3 by frame hinges 61. These hinges 61 are attached to the tank basin 3 inwardly from the hinges 62, FIG. 8, which connect the tank top 2 to the basin 3. The frame 60 is attached to the tank so that it can either be raised into the tank top 2 or positioned over the tank basin 3 during operation. The latter view with the frame 60 in operating position is shown in FIG. 8. A plurality of uniformly spaced agitator bars 63 are mounted to this frame 60. These bars 63 contact simultaneously with and agitate both sides of adjoining floor maintenance pads placed therebetween during rotation of the pads.

Figure 9:
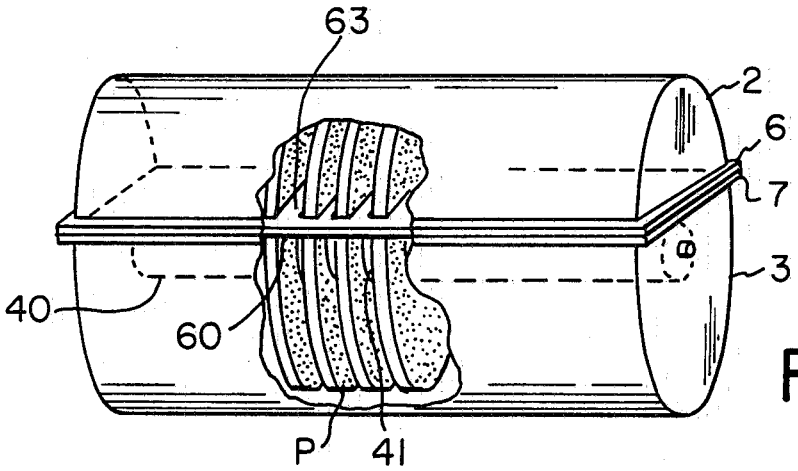
FIG. 9 is a perspective, cutaway view of a closed and partially loaded operating tank.

FIG. 9 shows the closed operating tank 1 with the agitator bar frame 60 lowered in position around several floor maintenance pads P. These pads P are further aligned on the axle 40, shown in dotted lines, by the gripper rings 41 placed therebetween. In this view, uniformly-sized pads are being cleaned. However, pads with varying outside diameters can also be cleaned simultaneously with my invention.

Preferably, the operation of my invention proceeds as follows. A plurality of maintenance pads and gripper rings 41 are alternately positioned onto the drive axle 40. The drive axle 40 is then secured into mounts in the tank basin 3. The electric pump 31 is turned on to fill the tank 1 to a preferred level. The motor 22 is turned on for a cycle lasting roughly five minutes. The floor pads on the drive axle 40 are rotated in the cleaning solvent only. Thereupon, the agitator frame 60 is lowered from the tank top 2 into position over and between the pads. If need be, overly contaminated solvent is disposed of and newer solvent added. The motor 22 is again turned on for an agitation cycle lasting roughly fifteen minutes. Again, depending upon the contamination level of the cleaning solvent, either the return valve 36 or discharge valve 38 is opened for removal of solvent from the drain hole 37 near the bottom of the tank basin 3.

Most preferably, a rinse cycle, using normal tap water, is run for five minutes with the motor 22 on. Thereupon, the rinse water is drained through the discharge valve 38 and motor 22 allowed to run an additional five minutes to promote drying of the floor pads.

Having presently described the preferred embodiments of my invention, it is to be understood that it may be otherwise embodied within the scope of the appended claims.

I claim:

1. A machine for cleaning a plurality of floor maintenance pads comprising:
- a top-loading operating tank;
- a removable drive axle, horizontally and rotatably mounted within said tank, upon which a plurality of floor pads can be loaded;
- means for rotating said drive axle from outside said tank;
- means for filling said tank from a container of cleaning solvent; and
- means for agitating the floor pads with said tank, said agitating means including:
  - an agitator bar frame mounted to the interior of said tank such that the cleaning machine may be operated either with said frame raised or lowered over the floor pads on said drive axle; and
  - a plurality of uniformly-spaced agitator bars, mounted to said frame, for contacting simultaneously with both sides of the floor pads placed therebetween.

2. The cleaning machine of claim 1 wherein the rotating means includes:
- a rotatable shaft having one end which passes through a shaft hole in a side of said tank and attaches to said drive axle;
- a variable speed motor attached to the other end of said shaft; and
- a motor on/off switch.

3. The cleaning machine of claim 2 wherein the filling means includes:
- an inlet into said tank;
- an electric pump connected to said inlet;
- means for connecting said pump to the container of cleaning solvent; and
- a pump on/off switch.

4. The cleaning machine of claim 3 wherein said pump, said motor, said pump switch and said motor switch are mounted to an activities platform adjacent to and between the side of said tank and the container of cleaning solvent.

5. The cleaning machine of claim 1 which further comprises:
- a support stand for holding said tank and the container of cleaning solvent; and
- a plurality of casters attached to a lower end of said support stand.

6. A machine for cleaning a plurality of floor maintenance pads comprising:
- a cylindrically shaped, top-loading operating tank divided into a tank top and a tank basin;
- a removable drive axle, horizontally and rotatably mounted to an interior of said tank basin, and upon which a plurality of floor pads can be loaded;
- means for rotating said drive axle from outside of said tank;
- means for agitating the floor pads within said tank; and
- means for filling said tank with and emptying said tank of a cleaning solvent, said filling and emptying means including:
  - a pair of drain valves which return the cleaning solvent to a container of solvent and alternately discharge the cleaning solvent;
  - an inlet into said tank;
  - an electric pump connected to said inlet and container of solvent; and
  - a pump on/off switch.

7. The cleaning machine of claim 6 wherein the rotating means includes:
- a rotatable shaft having one end which passes through a shaft hole in the side of said tank basin and attaches to said drive axle;
- a variable speed motor connected to the other end of said shaft; and
- a motor on/off switch.

8. The cleaning machine of claim 7 wherein said pump, said motor, said pump switch and said motor switch are mounted to an activities platform adjacent to and between the side of said tank and the container of the cleaning solvent.

9. The cleaning machine of claim 6 wherein the agitating means includes:
- an agitator bar frame hinged to an inside of said tank;
- an plurality of uniformly-spaced agitator bars mounted to said frame for contacting simultaneously with both sides of the floor pads placed therebetween; and
- a plurality of gripper rings for loading onto said drive axle alternately with the floor pads, said rings having a spiny, gripping material attached to one side for gripping onto the floor pad while allowing for slight movement therebetween.

10. The cleaning machine of claim 6 which further includes:
- a support stand for holding said tank and the container of the cleaning solvent; and
- a plurality of casters attached to a lower end of said support stand.

* * * * *

UNITED STATES PATENT AND TRADEMARK OFFICE

CERTIFICATE OF CORRECTION

PATENT NO. : 4,597,126

DATED : July 1, 1986

INVENTOR(S): Robert A. Beech

It is certified that error appears in the above-identified patent and that said Letters Patent is hereby corrected as shown below:

Claim 1 - Column 5 Line 49 "with" should read —within—.

Signed and Sealed this

*Twenty-third* Day of *September 1986*

[SEAL]

*Attest:*

DONALD J. QUIGG

*Attesting Officer* *Commissioner of Patents and Trademarks*